US011174683B2

(12) United States Patent
Bielawa et al.

(10) Patent No.: US 11,174,683 B2
(45) Date of Patent: Nov. 16, 2021

(54) TAPERED JOINT FOR SECURING CONE ARM IN HOLE OPENER

(71) Applicant: Century Products Inc., Sussex, WI (US)

(72) Inventors: Todd Bielawa, Hartland, WI (US); Christopher Irgens, Brookfield, WI (US); Andrew Houdek, Milwaukee, WI (US)

(73) Assignee: CENTURY PRODUCTS, INC., Sussex, WI (US)

( * ) Notice: Subject to any disclaimer, the term of this patent is extended or adjusted under 35 U.S.C. 154(b) by 86 days.

(21) Appl. No.: 16/797,630

(22) Filed: Feb. 21, 2020

(65) Prior Publication Data

US 2020/0270952 A1 Aug. 27, 2020

Related U.S. Application Data

(60) Provisional application No. 62/809,984, filed on Feb. 25, 2019.

(51) Int. Cl.
*E21B 10/20* (2006.01)
*E21B 10/28* (2006.01)
(Continued)

(52) U.S. Cl.
CPC ..... *E21B 10/20* (2013.01); *E21B 7/046* (2013.01); *E21B 7/28* (2013.01); *E21B 10/28* (2013.01); *E21B 10/62* (2013.01)

(58) Field of Classification Search
CPC ..... E21B 10/20; E21B 10/28
See application file for complete search history.

(56) References Cited

U.S. PATENT DOCUMENTS 979,496 A * 12/1910 Hughes ..... E21B 10/20 175/368
1,636,668 A * 7/1927 Reed ..... E21B 10/20 175/366

(Continued)

OTHER PUBLICATIONS

Alibaba, Product—TCI Tricone, https://korean.alibaba.com/product-detail/TCI-tricone-bit-tricone-drill-bit-1950415522.html. Copyright 1999-2020 Alibaba.com, 14 pages.

(Continued)

*Primary Examiner* — Blake Michener
(74) *Attorney, Agent, or Firm* — Quarles & Brady LLP

(57) ABSTRACT

A hole opener includes a body with cone arms. The body includes pockets formed in the body in which each of the pockets includes a forwardly-positioned shoulder pocket section, a rearwardly-positioned tapered pocket section and a base opening axially extending through a wall of the corresponding pocket that receives a fastener therethrough. The cone arms each include a cone head attached to an arm. The arm includes a forwardly-positioned shoulder arm section, a rearwardly-positioned tapered arm section, and a rearwardly-facing opening axially extending through the rearwardly-positioned tapered arm section that receives the fastener. When each of the cone arms is inserted into a corresponding one of the pockets and the corresponding fastener(s) is/are tightened, the rearwardly-positioned tapered arm section is securely drawn into the rearwardly-positioned tapered pocket section of the pocket to create a pre-loaded fit therebetween and the forwardly-positioned shoulder arm section mates with the forwardly-positioned shoulder pocket section.

19 Claims, 5 Drawing Sheets

(51) Int. Cl.

| | |
|---|---|
| ***E21B 7/28*** | (2006.01) |
| ***E21B 10/62*** | (2006.01) |
| ***E21B 7/04*** | (2006.01) |

(56) References Cited

U.S. PATENT DOCUMENTS

| | | | | |
|---|---|---|---|---|
| 1,658,919 | A * | 2/1928 | Bull | E21B 10/20 175/368 |
| 1,692,793 | A * | 11/1928 | Reed | E21B 10/20 175/369 |
| 1,908,049 | A * | 5/1933 | Reed | E21B 10/20 175/313 |
| 2,065,743 | A * | 12/1936 | Reed | E21B 10/20 175/366 |
| 2,171,057 | A * | 8/1939 | Crum | E21B 10/20 175/340 |
| 2,216,894 | A * | 10/1940 | Stancliff | E21B 10/10 175/363 |
| 3,444,939 | A * | 5/1969 | Bechem | E21B 10/28 175/334 |
| 3,917,011 | A * | 11/1975 | Hester | E21B 10/18 175/339 |
| 4,108,259 | A * | 8/1978 | Dixon | F16D 1/097 175/344 |
| 4,369,849 | A | 1/1983 | Parrish | |
| 4,630,693 | A * | 12/1986 | Goodfellow | E21B 10/50 175/366 |
| 4,666,000 | A * | 5/1987 | Evans | E21B 10/22 175/369 |
| 4,738,322 | A * | 4/1988 | Hall | E21B 10/20 175/371 |
| 5,201,795 | A * | 4/1993 | Howard | B23P 15/28 29/898.042 |
| 5,337,843 | A * | 8/1994 | Torgrimsen | E21B 10/20 175/334 |
| 5,641,029 | A * | 6/1997 | Beaton | E21B 10/20 175/356 |
| D384,084 | S * | 9/1997 | Huffstutler | D15/139 |
| 5,941,322 | A | 8/1999 | Stephenson et al. | |
| 5,979,574 | A * | 11/1999 | Osadchuk | E21B 7/046 175/353 |
| 6,386,298 | B1 * | 5/2002 | Smith | E21B 10/20 175/385 |
| 6,458,430 | B1 | 10/2002 | Bernstein et al. | |
| 6,527,066 | B1 | 3/2003 | Rives | |
| 6,729,418 | B2 | 5/2004 | Slaughter, Jr. et al. | |
| 6,742,608 | B2 * | 6/2004 | Murdoch | E21B 10/20 175/366 |
| 6,745,858 | B1 * | 6/2004 | Estes | E21B 10/20 175/384 |
| 6,776,247 | B1 * | 8/2004 | Bassal | E21B 17/22 175/325.4 |
| 6,902,014 | B1 | 6/2005 | Estes | |
| 7,137,460 | B2 * | 11/2006 | Slaughter, Jr. | E21B 10/28 175/53 |
| 7,152,702 | B1 * | 12/2006 | Bhome | E21B 10/345 175/384 |
| 7,197,806 | B2 | 4/2007 | Boudreaux et al. | |
| 7,458,430 | B2 | 12/2008 | Fyfe | |
| 8,177,000 | B2 * | 5/2012 | Bhome | E21B 7/28 175/384 |
| 8,347,989 | B2 * | 1/2013 | Buske | E21B 10/14 175/335 |
| 8,439,134 | B2 * | 5/2013 | Vezirian | E21B 10/22 175/371 |
| 9,476,259 | B2 * | 10/2016 | Ricks | E21B 10/16 |
| 9,689,208 | B2 * | 6/2017 | Thomas | E21B 10/26 |
| 10,132,122 | B2 | 11/2018 | Ricks et al. | |
| 2002/0108785 | A1 * | 8/2002 | Slaughter, Jr. | E21B 10/28 175/53 |
| 2010/0206638 | A1 * | 8/2010 | Bielawa | E21B 10/28 175/356 |
| 2010/0319993 | A1 * | 12/2010 | Bhome | E21B 7/28 175/53 |
| 2011/0079443 | A1 | 4/2011 | Buske et al. | |
| 2012/0205160 | A1 * | 8/2012 | Ricks | E21B 10/14 175/331 |
| 2013/0133954 | A1 * | 5/2013 | Mohon | E21B 10/28 175/345 |
| 2014/0338979 | A1 * | 11/2014 | Gunsaulis | E21B 10/28 175/57 |
| 2015/0027785 | A1 * | 1/2015 | Lane | E21B 10/62 175/320 |
| 2017/0167202 | A1 * | 6/2017 | Wagner | E21B 7/28 |
| 2019/0178037 | A1 * | 6/2019 | Bielawa | E21B 10/25 |

OTHER PUBLICATIONS

DDI Bits Inc., First Corp International Website, Diamond Drilling Industries, http://ddibits.com/, Copyright 2017 FCI, 6 pages.

Exploration Core Drilling, Products, http://german.explorationcoredrilling.com/sale-10266482-rock-reamers-4-inch-to-48-inch-pilot-hole-reamer-most-vertsatile-hole-opener-for-hdd.html, Copyright 2015-2019 explorationcoredrilling.com, 5 pages.

Hebei Zhongcheng Drill Bit Manufacture Co. Ltd., Products, http://www.triconebitsale.com/, Copyright 2020, 5 pages.

Hejian Hengji Bit Manufacture Co., Ltd., HDD Rock Reamer Replaceable Roller Cone Drill Bits, Single Roller Bits Cutter for Piling, https://hb-bits.en.made-in-china.com/product/ljlmncWTYPVB/China-HDD-Rock-Reamer-Replaceable-Roller-Cone-Drill-Bits-Single-Roller-Bits-Cutter-for-Piling.html, Copyright 1998-2020 Focus Technology Co. Ltd., 5 pages.

Hejian Hengji Bit Manufacture Co., Ltd., Rock Reamer Hole Opener with Pilot Bit, https://hb-bits.en.made-in-china.com/product/ISkndRrGHCWT/China-Rock-Reamer-Hole-Opener-with-Pilot-Bit.html, Copyright 1998-2020 Focus Technology Co. Ltd., 4 pages.

Inrock, Product—XTR-S—https://www.inrock.com/products/xtr-s/, Copyright 2020 Inrock Drilling Systems, Inc., 3 pages.

Longyue, Products—Roller Cones, http://www.triconerockbit.com/supplier-278390-roller-cones, Copyright 2018-2019 triconerockbit.com, 2 pages.

Nord-Lock, Nord-Lock Original Washers, https://www.nord-lock.com/en-us/nord-lock/products/washers, Copyright 2020 Nord-Lock International AB, 6 pages.

Prodrill Equipment Co., Ltd., HDD Hole Opener, http://www.prodrill.com.cn/displayTab.asp?bigclassid=10&sedclassid=167&thdclassid=206&kind=class&classid=206, Copyright 2016, 3 pages.

Yanggu Haoquan Rock Tools Co., Ltd., Product Catalog—Roller Cone Bits, http://www.hqrocktools.com/sdp/188056/4/pd-1013484/17666898-1472483/Roller_Cone_Bits.html, 2019, 5 pages.

PCT International Search Report and Written Opinion, PCT/US2020/19243, dated May 15, 2020, 11 pages.

* cited by examiner

TAPERED JOINT FOR SECURING CONE ARM IN HOLE OPENER

CROSS-REFERENCE TO RELATED APPLICATIONS

This application claims the benefit of U.S. Provisional Application No. 62/809,984, filed Feb. 25, 2019, which is hereby incorporated by reference for all purposes as if set forth in its entirety herein.

TECHNICAL FIELD

The present disclosure relates to hole openers for horizontal and vertical drilling through rock and/or earth. In particular, this disclosure relates to arrangements for mounting cone arms into the pockets in bodies of hole openers or other earth-boring tools.

BACKGROUND

Tri-cone bits and hole openers are commonly used to drill and bore through rock and/or earth. To break apart the rock and/or earth, tri-cone bits and hole openers typically have one or more cutting elements that are spaced around and coupled to a rotating shaft and body. During operation, the shaft axially loads the cutting elements by forcing the cutting elements against the rock by pushing or pulling the attached shaft and body. The further simultaneous rotation of the shaft and body causes the hardened surfaces of the cutting elements to be forcefully drawn into the rock and/or earth and to break it apart. Typically, tri-cone bits are used in vertical and horizontal drilling operations and up to diameters approaching 36 inches, while hole openers are used in horizontal drilling operations and cut holes up to 60 inches in diameter.

Typically, the cutting elements are presented as parts of cone arm assemblies that are assembled into the tri-cone bit or placed into a body of the hole opener. A cone mates to the arm journal of the arm through bearings, bushings, thrust washers, and seals, thereby permitting the cone to rotate relative to the arm, which is in turn mounted to the body. The cone includes, for example, carbide inserts or hard-faced teeth which progressively fracture the rock or earth to perform a cutting action against the earth or rock under the applied force during rotation of the hole opener or tri-cone bit. The arms of such cone arm assemblies are often received radially into outwardly facing pockets of the body of the hole opener and are welded in the pocket to the body or onto the shaft so that the cone arm assemblies are positioned and retained on the body under the stress of use.

SUMMARY

As noted above, the cone arm assemblies are traditionally welded into pockets of the greater hole opener assembly resulting in one unified structure. However, when one of the cone arms fail—for example, if the cutting head breaks—then the remainder of cone arm needs to be removed from the body and replaced. Given that a weld secures the cone arm to the hole opener, this replacement requires both skilled labor and time to execute the replacement. For example, the entire hole opener will need to be removed from service while the cone arm is removed from the body and the new cone arm is welded to the body. This replacement comes at great cost because it can take hours, if not days, to replace the cone arm. Moreover, there are limits to the number of times that a cone arm can be removed from the body and a new cone arm welded into place before the body itself requires replacement or rework. Accordingly, it is often the case that, to reduce downtime, multiple bodies and cone arms may need to be kept on site and a welder readily available to service the hole opener when a failure of a cone arm occurs. Still further, even absent the failure of a cone arm, it may be desirable to replace one type of cone arm with another type in the hole opener (for example, having a different type of cutting head based on the material to be cut) and existing weld-based assemblies are not well-suited for such wholesale replacement of various cone arms in a hole opener.

Disclosed herein is an improved structure for cone arm and related methods in which a cone arm is mechanically receivable in a pocket of the body in an axial direction and can be secured in place within the pocket by one or more fasteners. Notably, the cone arm and corresponding pocket have a two-portion construction in which a tapered section primarily secures the arm in the pocket similar to how a tool can be inserted in machining equipment, as well as a keyed section which is provided in order to provide improved stress distributions when the cone arm is loaded. Further, the keyed section provides appropriate angular orientation and position of the cone arm in the pocket.

According to one aspect, a hole opener is provided in which the cone arms can be easily replaced using fasteners and without welding and in which the mechanical securement and stress distribution is provided using a two-part arm construction involving one portion of the arm that is tapered and one portion of the arm that acts to be a keyed-front pocket to improve stress distribution during use and orientate the arm with the pocket to the desired position. The hole opener includes a body extending along a rotational axis. Pockets are formed in the body and these pockets are angularly arranged about the rotational axis of the body. Each of the pockets includes a forwardly-positioned shoulder pocket section, a rearwardly-positioned tapered pocket section and a base opening axially extending through a wall of the corresponding pocket that receives one or more fasteners therethrough. The hole opener also includes cone arms with each of the cone arms including a cone head attached to an arm. The arm includes a forwardly-positioned shoulder arm section, a rearwardly-positioned tapered arm section, and a rearwardly-facing opening axially extending through the rearwardly-positioned tapered arm section that receives the fastener(s). When each of the cone arms is inserted into a corresponding one of the pockets and the corresponding fastener(s) are tightened, the rearwardly-positioned tapered arm section is securely drawn into the rearwardly-positioned tapered pocket section of the pocket to create an pre-loaded fit therebetween and the forwardly-positioned shoulder arm section of the respective cone arm mates with the forwardly-positioned shoulder pocket section of the respective pocket.

In some forms, the rearwardly-positioned tapered pocket section of each of the pockets may include a tubular insert in the body and the tubular insert includes a taper that contacts the rearwardly-positioned tapered arm section of the cone arm.

In some forms, by virtue of the pre-loaded fit between the rearwardly-positioned tapered arm section and the rearwardly-positioned tapered pocket section by their drawing together by the fastener(s), the rearwardly-positioned tapered arm section and the rearwardly-positioned tapered pocket section may be locked together in an interference fit. However, in other forms, the pre-loaded fit between the rearwardly-positioned tapered arm section and the rearwardly-positioned tapered pocket section by their drawing together by the fastener(s) may not provide sufficient loading to lock the rearwardly-positioned tapered arm section and the rearwardly-positioned tapered pocket section together upon release of the fastener load for disassembly.

In some forms, the rearwardly-positioned tapered pocket section and the rearwardly-positioned tapered arm section may have a cylindrically-shaped tapered geometry. In such case, for example, the rearwardly-positioned tapered pocket section and the rearwardly-positioned tapered arm section may have a taper of 7.5 degrees. However, a range of 7 to 15 degrees is certainly contemplated as being workable in this design.

In some forms, the forwardly-positioned shoulder pocket section and the forwardly-positioned shoulder arm section may have a rectangular-shaped geometry.

In some forms, the cone arms may be secured in the pockets by the fastener(s) only and there may be no welds holding the cone arms in the pockets.

In some forms, each of the cone arms may be securely drawn into a corresponding one of the pockets by a group of fasteners and each of the pairs of cone arms and pockets may be secured using more than one fastener. In such case, the fasteners may be arranged at different radial distances from a rotational axis of the hole opener.

In some forms, the forwardly-positioned shoulder pocket section and the forwardly-positioned shoulder arm section may have corresponding profiles and mate with one another, but they do not form an interference fit with one another.

In some forms, the outer diameter of the hole opener may be in a range of 18 to 30 inches. More broadly yet, it is contemplated that the outer diameter of the hole opener may be in a range of 12 to 60 inches.

In some forms, the hole opener may further include a pocket step between the rearwardly-positioned tapered pocket section and the forwardly-positioned shoulder pocket section and further include a cone arm step between the rearwardly-positioned tapered arm section and the forwardly-positioned shoulder arm section.

According to another aspect, a method of installing a cone arm into a hole opener is provided. The cone arm includes a cone head attached to an arm in which the arm includes a forwardly-positioned shoulder arm section, a rearwardly-positioned tapered arm section, and a rearwardly-facing opening axially extending through the rearwardly-positioned tapered arm section. This cone arm is inserted into a pocket formed in a body of the hole opener in which the pocket includes a forwardly-positioned shoulder pocket section, a rearwardly-positioned tapered pocket section and a base opening axially extending through a wall of the corresponding pocket such that the rearwardly-positioned tapered arm section of the arm is received in the rearwardly-positioned tapered pocket section of the pocket and such that the forwardly-positioned shoulder arm section is received in the forwardly-positioned shoulder pocket section of the pocket. The cone arm is secured into the pocket by tightening one or more fasteners that are received through the base opening of the pocket and into the rearwardly-facing opening axially of the cone arm to draw the cone arm into secured engagement with the pocket.

In some forms, the method may further include a step of removing the cone arm from the pocket by removing the fastener(s).

In some forms, the method may involve no welding of the cone arm into the pocket and the fastener(s) alone may secure the cone arm into the pocket.

In some forms, the method may further include a step of inserting a tubular insert into the rearwardly-positioned tapered pocket section of the pocket of the body in which the tubular insert includes a taper for coming into contact with rearwardly-positioned tapered arm section and the step of insertion of the tubular insert occurs before the step of inserting the cone arm into the pocket.

In some forms, securing the cone arm into the pocket by tightening the fastener(s) may create a pre-loaded fit between the rearwardly-positioned tapered arm section of the arm and the rearwardly-positioned tapered pocket section of the pocket. This may create an interference fit between the rearwardly-positioned tapered arm section of the arm and the rearwardly-positioned tapered pocket section of the pocket that locks the cone arm in the pocket. However, it is also contemplated that the tightening of fastener(s) need not be so tight as to create a lock between the two components upon release of the fastener load for disassembly of the components from one another.

In some forms, the forwardly-positioned shoulder pocket section and the forwardly-positioned shoulder arm section may have corresponding profiles and mate with one another, but do not form an interference fit. This close correspondence may result, upon use of the hole opener in a drilling operation, in at least some of the surfaces of the forwardly-positioned shoulder pocket section and the forwardly-positioned shoulder arm section contacting one another. This contact can further distribute stresses from the cone arm to the pocket in the surfaces of contact between the forwardly-positioned shoulder pocket section and the forwardly-positioned shoulder arm section (especially during extreme loading conditions) and not just distribute stresses between the rearwardly-positioned tapered arm section of the arm and the rearwardly-positioned tapered pocket section (which are already in direct contact with one another).

These and still other advantages of the invention will be apparent from the detailed description and the drawings. What follows is merely a description of some preferred embodiments of the present invention. To assess the full scope of the invention, the claims should be looked to, as these preferred embodiments are not intended to be the only embodiments within the scope of the claims.

BRIEF DESCRIPTION OF DRAWINGS

The invention will be better understood and features, aspects, and advantages other than those set forth above will become apparent when consideration is given to the following detailed description thereof. Such detailed description makes reference to the following drawings.

Figure 1:
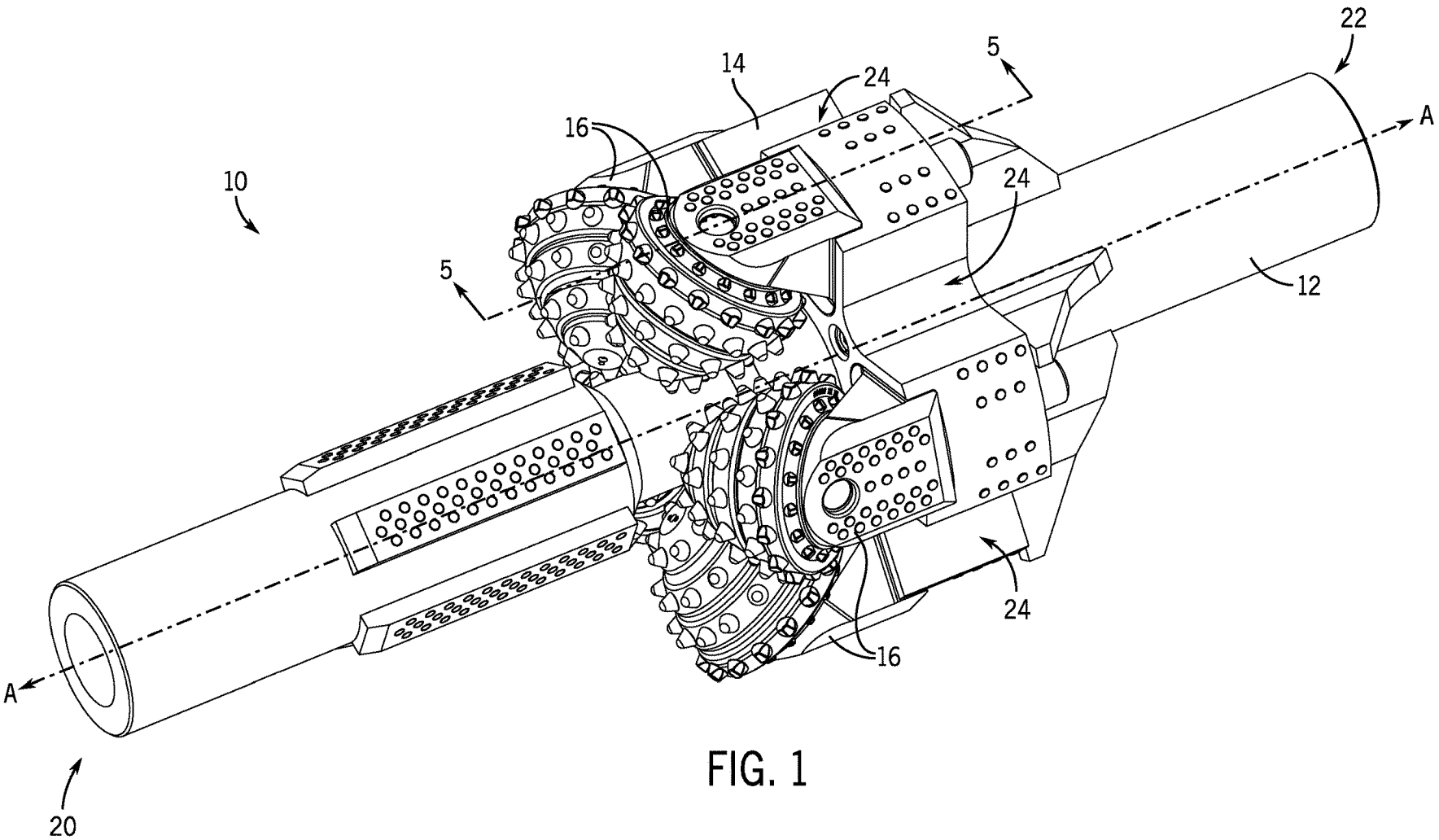
FIG. 1 is a perspective view of a hole opener according to an exemplary embodiment.

Corresponding reference characters indicate corresponding parts throughout the several views. Although the drawings represent embodiments of the present disclosure, the drawings are not necessarily to scale and certain features may be exaggerated in order to better illustrate and explain the embodiments of the present disclosure.

DETAILED DESCRIPTION

Referring first to FIG. 1, a hole opener 10 is illustrated for drilling and boring through earth and rock. The hole opener 10 includes a central shaft 12 to which a body 14 attached with both the central shaft 12 and the body 14 commonly sharing a rotational axis A-A. A plurality of cone arms 16 are inserted into a corresponding plurality of pockets 18 (not illustrated in FIG. 1, but viewable in FIG. 2). As illustrated, there are five cone arms 16 angularly spaced around the rotational axis A-A and received in five corresponding pockets 18 of the body 14. However, the number of cone arms and pockets may be different than those illustrated and the number of cone arms and pockets is scalable with the size of the hole opener 10 as well as the size of cone arms and pockets themselves.

For the ease of description, some directionality is now provided based on the typical use of the hole opener 10. The hole opener 10 and its various constituent components have a forward end 20 and a rearward end 22. In use, the hole opener 10 is attached to a greater shaft structure and rotated to be pulled in the "forward" direction through a pre-existing, but smaller opening to enlarge the opening to the diameter of the hole opener 10 or pushed in the "rearward" direction. As this pulling or pushing occurs, the cutting elements on the cone arms 16 cut the surrounding rock and earth to dislodge the rock and earth from the opening and this separated rock and earth, when broken down to a sufficiently small size, is able to pass through gaps or spaces 24 between the pockets 18 so that the cut material can be displaced and the hole opener 10 pulled further forward or pushed further back.

In the construction described below, a weldless attachment is described between the cone arms 16 and the pockets 18. The attachment involves securement of the cone arms 16 in the pockets 18 by using a unique two-section cone arms and pocket construction which enables the cone arms 16 to be secured in the pockets 18 using fasteners alone. Such structures are viewed as being particularly advantageous in relatively small hole openers having a diameter of 18 to 30 inches, although might have potential applicability to larger structures. As the size of the hole opener and the size of the opening cut by the hole opener increases, the cone arm and pockets may be exposed to more and different kinds of stresses and it is possible that the type of fastener only arrangement may be complicated to scale. While the unique structures and fastener-based modes of attachment which lack welds are understood to be particularly suitable for these smaller diameters, additional work may need to be performed to understand whether they possess sufficient strength for typical operation in larger hole openers (i.e., hole openers having diameters exceeding 30 inches) in a commercially viable way.

Figure 2:
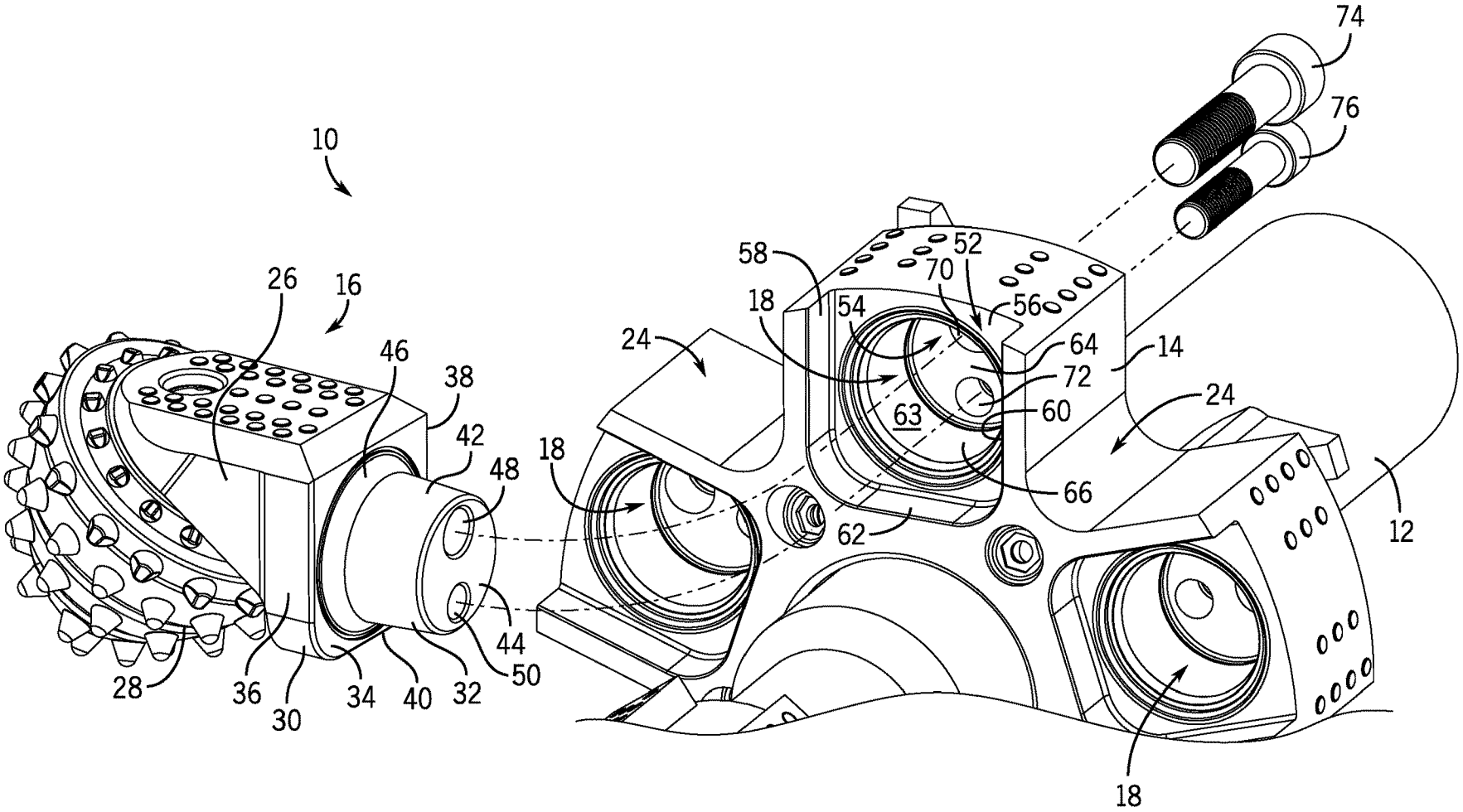
FIG. 2 is a detailed exploded perspective view of the hole opener of FIG. 1 in which one of the cone arms and its associated fasteners are shown exploded from the body to better illustrate the profile of the pocket into which the cone arm is received. In this view, the other pockets are also illustrated without the cone arms in them.

Turning now to FIG. 2, one of the cone arms 16 is shown removed from the pocket 18 of the body 14 to better illustrate the geometric profile of the cone arm 16 and the pocket 18.

Figure 3A:
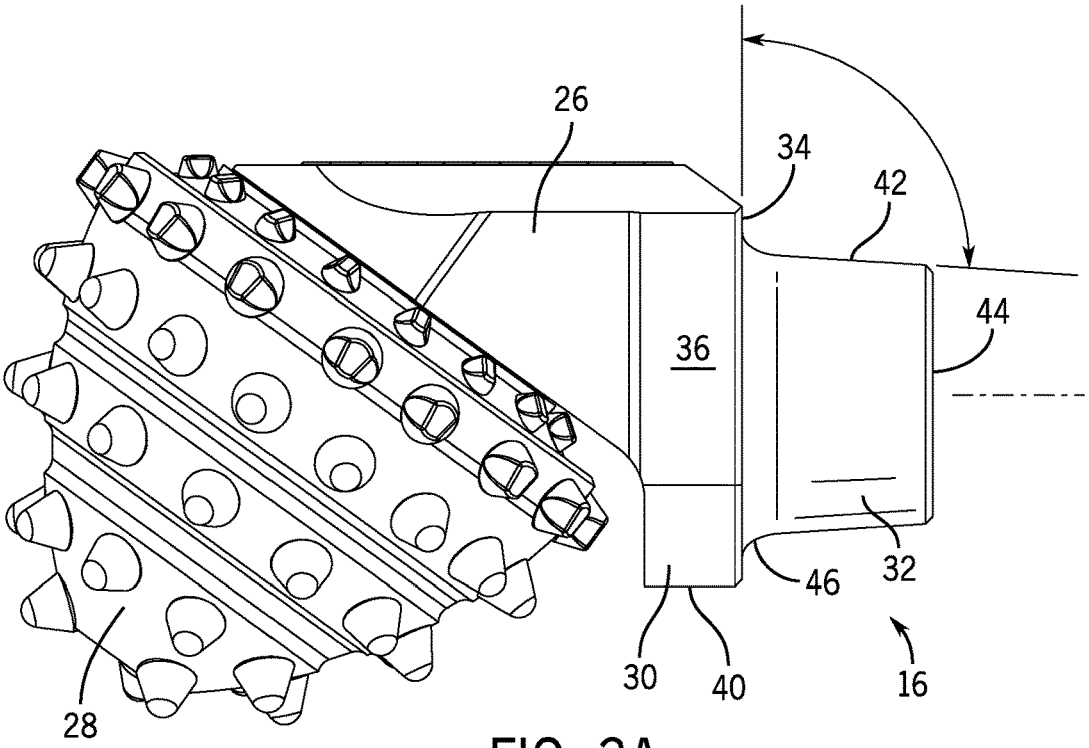
FIG. 3A is a side plan view of one of the cone arms from the hole opener of FIG. 1 apart from the hole opener to better illustrate the taper on the rearwardly-positioned tapered arm section.
Figure 3B:
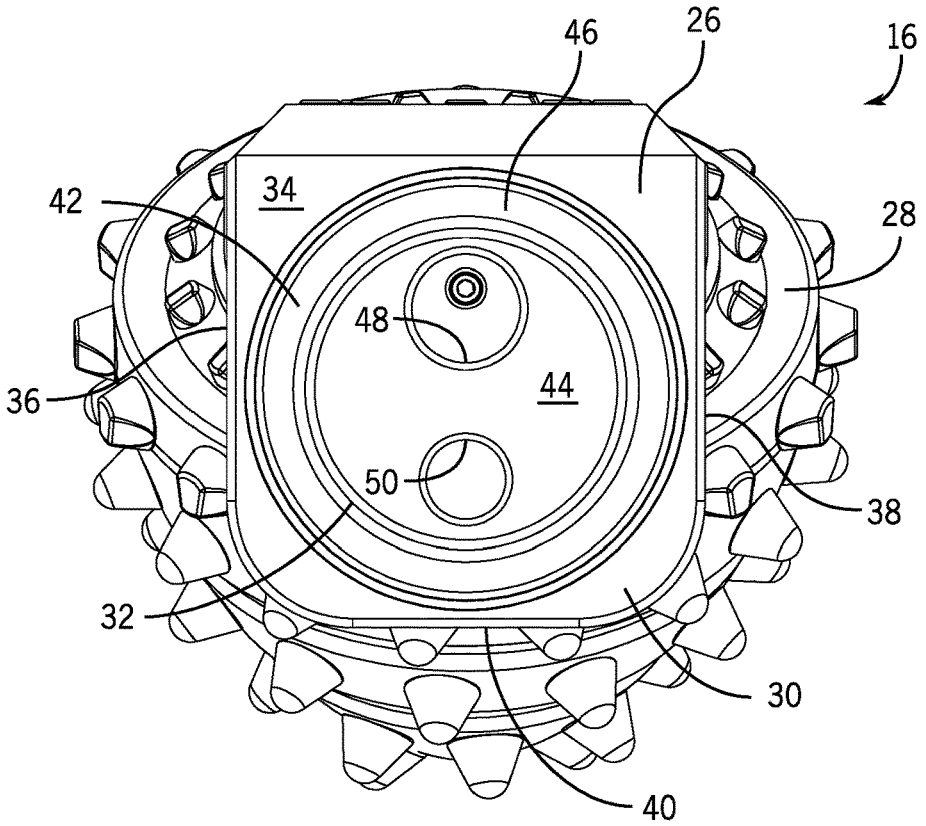
FIG. 3B is a rear plan view of the cone arm of FIG. 3A to better illustrate the profile of the forwardly-positioned shoulder arm section of the cone arm.

With continued reference being made to FIG. 2 and further reference being made to FIGS. 3A and 3B, the cone arm 16 is illustrated as having an arm 26 with a cone 28 attached to a forward end thereof. As best shown in the cross section of FIG. 5, the cone 28 is attached to an post on the forward end of the arm 26 that is angled so as to be inclined towards the rotational axis A-A and includes bearings and seals which permit the rotation of the cone 28 relative to the arm 26 around that inclined post during use. The cone 28 includes various cutting elements on the surfaces thereof for engaging and cutting rock and/or earth while the arm 26 is designed for reception into the pocket 18 of the body 14.

Notably for purposes of the unique attachment structure that is described herein, the arm 26 of the cone arm 16 includes two sections that have corresponding sections of the pocket 18. The arm 26 includes a forwardly-positioned shoulder arm section 30 and a rearwardly-positioned tapered arm section 32 with a cone arm step 34 therebetween. The forwardly-positioned shoulder arm section 30 is generally rectangular shaped (but not limited to this shape in general) when viewed along the axis of the arm 26 (as seen for example in FIG. 3B), having a pair of opposing lateral side walls 36 and 38 and a inwardly-facing side wall 40 with a curved transitional corner between those walls. It is noted that while the forwardly-positioned shoulder arm section 30 is illustrated as being rectangular, it could be various other shapes including V-shaped, wedge-shaped, and so one; given that, as will be described later the primary benefits of the forward sections of the arm and pocket are to improve stress distribution and provide desired positioning and alignment of the cone arms within the pockets, it will be readily appreciated that other geometries other than the illustrated rectangular geometry may be used instead. The rearwardly-positioned tapered arm section 32 is tapered cylinder shape having tapered walls 42 extending from the cone arm step 34 to a rearwardly-facing axial surface 44, with the rearward most end of the taper being the narrowest and with there being a curved transition or radius 46 in the transition from the cone arm step 34 to the tapered walls 42. It is contemplated that the taper could be to varying degrees but, as illustrated, a taper of approximately 7.5 degrees from a direction parallel with the rotation axis A-A is provided.

On the end of a rearwardly-facing axial surface 44 of the arm 26 which is at the end of the rearwardly-positioned tapered arm section 32, there are two axially-extending rearwardly-facing openings 48 and 50 which are threaded and are adapted to receive fasteners as will be described below for securing the cone arm 16 in the pocket 18. While there are two openings and two fasteners illustrated, it will be appreciated that one or more openings and fasters could be employed and the two-fastener arrangement is by way of example. The axially-extending rearwardly-facing openings 48 and 50 are at different radial distances from the rotational axis A-A of the hole opener 10 and, as illustrated, are placed with their centers being along the same radial line from the rotational axis A-A.

Figure 4A:
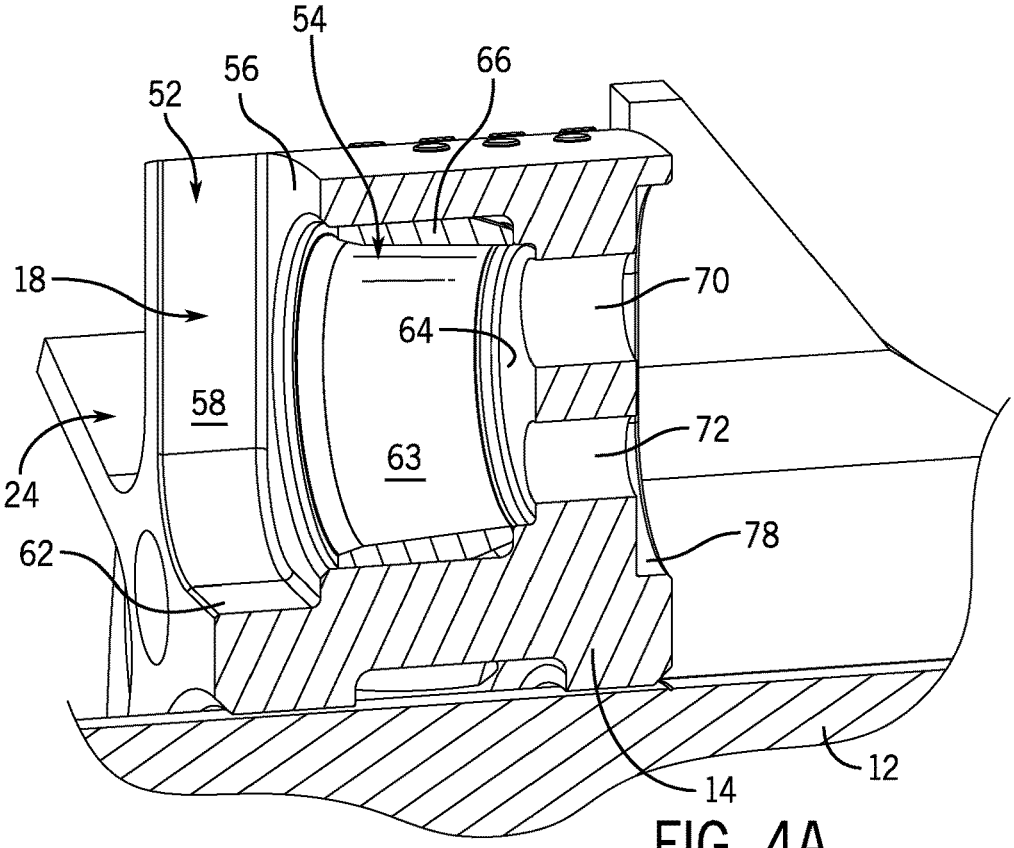
FIG. 4A is a side-cross sectional view of one of the pockets with a tubular insert received in the body to provide the taper and in which a cone arm is not received within the pocket.
Figure 4B:
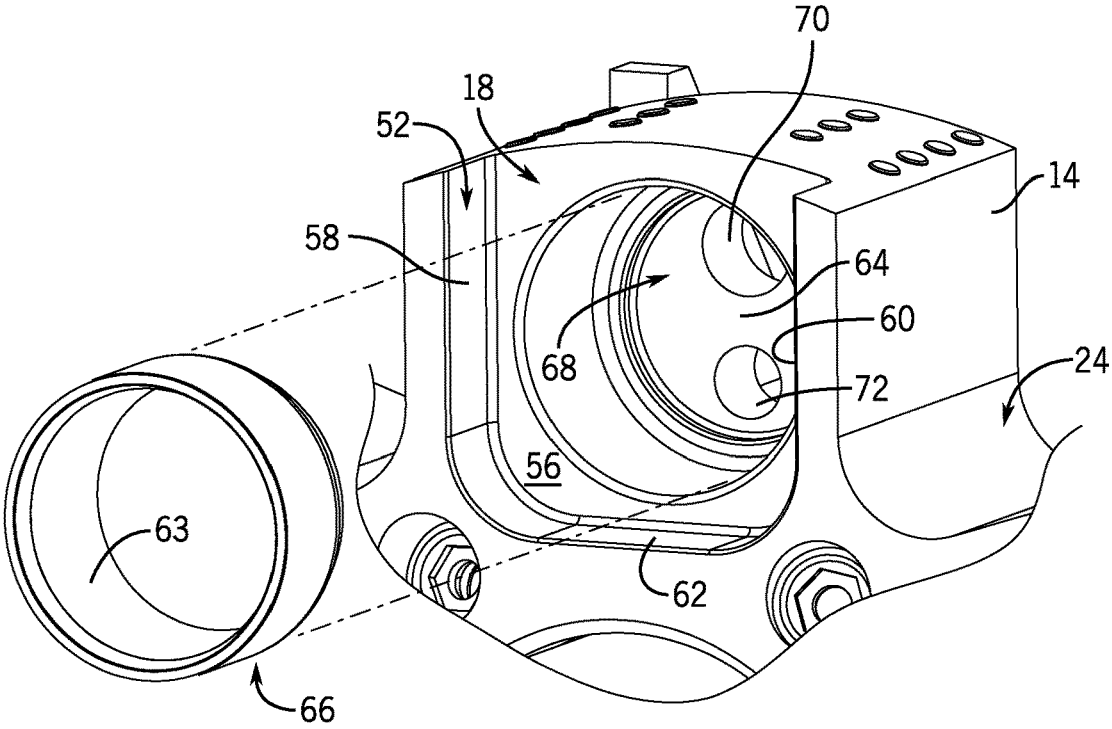
FIG. 4B is a detailed exploded view showing one of the pockets of the body with the tubular insert exploded therefrom.

With continued reference being made to FIG. 2 and further reference being made to FIGS. 4A and 4B, the pocket 18 is now further described. The pocket 18 also has a pair of sections similar to and corresponding with the pair of forward and rearward sections of the arm 26. Each pocket 18 includes a forwardly-positioned shoulder pocket section 52 and a rearwardly-positioned tapered pocket section 54 along with a pocket step 56 between the sections 52 and 54.

The forwardly-positioned shoulder pocket section 52 of the pocket 18 includes a profile that generally corresponds to the forwardly-positioned shoulder arm section 30 of the arm 26. The forwardly-positioned shoulder pocket section 52 is generally rectangular and includes a pair of opposing lateral side walls 58 and 60 and an outwardly-facing side wall 62 with a curved transitional corner between those walls. These walls generally correspond in shape and profile to the opposing lateral side walls 36 and 38 and the inwardly-facing side wall 40 of the forwardly-positioned shoulder arm section 30 of the arm 26; however, the various walls of the forwardly-positioned shoulder pocket section 52 and the forwardly-positioned shoulder arm section 30 are dimensioned so that there may be a slight gap between those walls (which is so small as to not even be perceivable in the illustrated drawings) when the arm 26 is received in the pocket 18.

Each pocket 18 also includes the rearwardly-positioned tapered pocket section 54 which is on the opposite side of the pocket step 56 from the forwardly-positioned shoulder pocket section 52. As illustrated, the rearwardly-positioned tapered pocket section 54 includes a profile and shape that is generally the negative of the rearwardly-positioned tapered arm section 32 of the arm 26. It includes a tapered cylindrical wall 63 that narrows as it extends axially backwards toward a base wall 64 of the pocket 18. While it is contemplated that the tapered cylindrical wall 63 could be formed directly in the body 14 (for example by machining), this tapered cylindrical wall 63 may also be achieved co-axially placing an insert 66 into an otherwise generally cylindrically-shaped opening 68 of the body 14 as best illustrated in FIG. 4B. One advantage of an insert-based construction is that it may be easier to machine separate inserts 66 and install them into the openings 68 of the pockets 18 rather than to machine the pockets directly, especially on larger body sizes. Another advantage of an insert-based construction is that is that a material can be selected for the insert that has preferential qualities for its application such as, for example, improved resistance to galling, fretting, and abrasive wear.

In the base wall 64, there are two base openings 70 and 72 which extend through the base wall 64 of the pocket 18 to the outside of the pocket 18. These base openings 70 and 72 correspond to the placement of the two axially-extending rearwardly-facing openings 48 and 50 of the arm 26 and, as will be described later, permit the arm 26 to be fastened into the pocket 18 with one or more fasteners 74 and 76 (see e.g., FIGS. 2 and 5).

Figure 5:
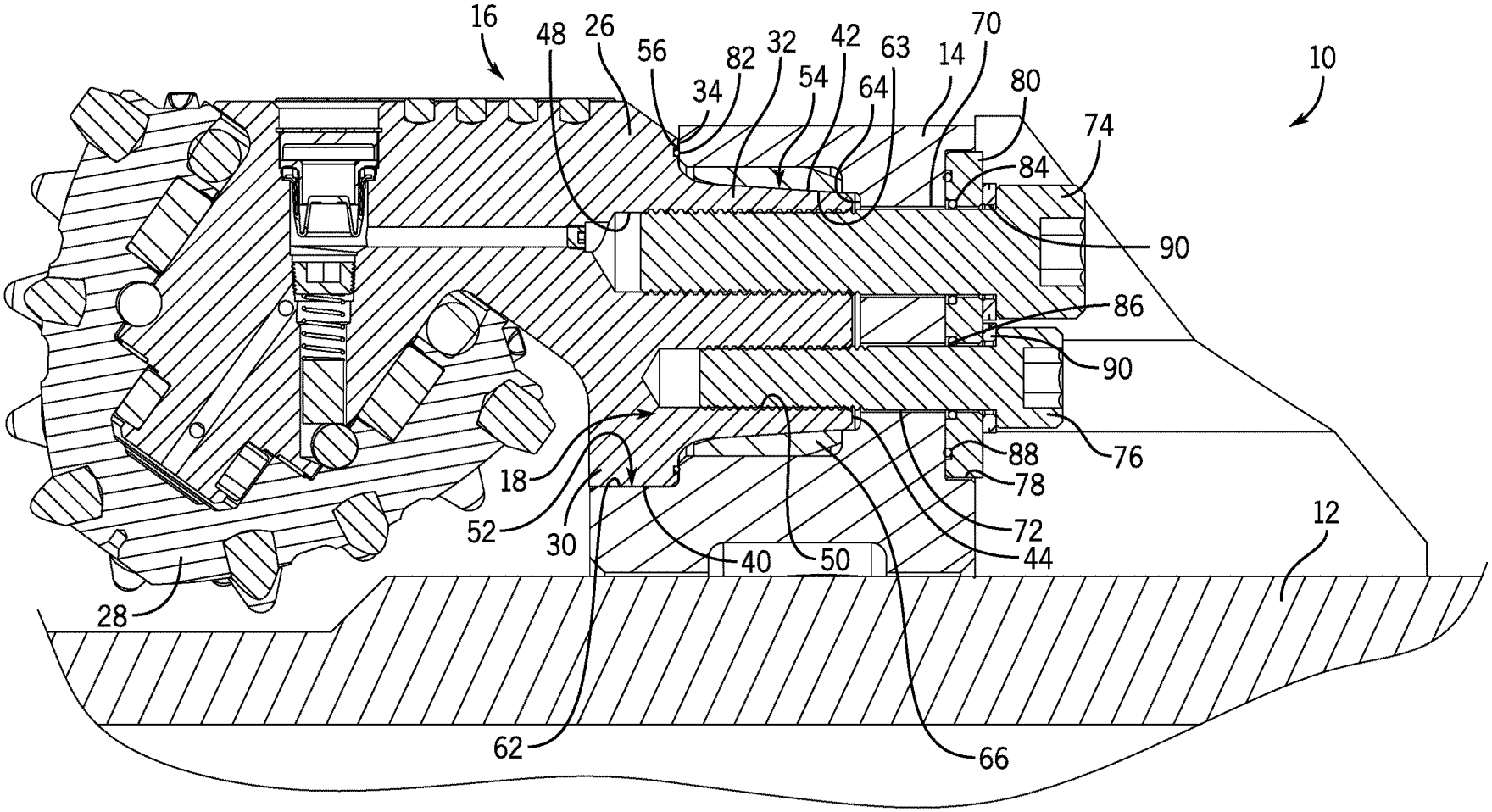
FIG. 5 is a side cross-sectional view taken through line 5-5 of FIG. 1 showing one of the cone arm and pockets with the cone arm received in and fastened into the pocket by fasteners.

As can also be seen in FIG. 4A, there is a rearwardly facing surface of the base wall 64 which has a recessed area 78 formed in it that can receive a mounting plate 80 (see FIG. 5). This mounting plate 80 may go between the heads of the fasteners 74 and 76 and/or washers and include a surface that can support seals to prevent ingress of fluid or debris into the cone arm/pocket interface. In addition to the supporting seals, the mounting plate can also add extra structural stiffness and strength for increased resistance to the dynamic bolt loads, can be made of a harder material than the base body so the washers or fastener assembly are less likely to result in interface wear/fretting and subsequently from being loosened, and can be periodically replaced should they wear (due to fastener assembly or during rock drilling) or corrode which can improve serviceability.

With the cone arm 16 and the pocket 18 structures having been separately described, the manner of assembly of one of the cone arms 16 into the pocket 18 can be described and understood. The completed assembly of one of the cone arms 16 into one of the pockets 18 is illustrated in FIG. 5, which perhaps best shows the completed mechanical connection.

Initially, when a body 14 is being assembled, to attach each of the cone arms 16 to a respective pocket 18, the following steps are performed starting from an empty pocket. First, if the rearwardly-positioned tapered pocket section 54 does not supply the taper for the pocket 18 in the as-formed body 14, such as is illustrated in FIG. 4B in which the insert 66 is inserted into an otherwise generally cylindrically-shaped opening 68 of the body 14, then an insert having the taper is inserted into an opening of the pocket 18 as illustrated in FIG. 4B to create the rearwardly-positioned tapered pocket section 54.

Next, the arm 26 of the cone arm 16 is axially inserted into the pocket 18. As illustrated, because the forwardly-positioned shoulder arm section 30 and the forwardly-positioned shoulder pocket section 52 have generally corresponding profiles (and the radially outwardmost portion of the pocket does not have a surrounding side wall), there is only one way for the arm 26 to be installed into the pocket 18. This single mode of insertion also results in the force alignment of the two axially-extending rearwardly-facing openings 48 and 50 of the arm 26 with the two base openings 70 and 72 of the pocket 18. Upon insertion, the rearwardly-positioned tapered arm section 32 is generally received in the rearwardly-positioned tapered pocket section 54 and the forwardly-positioned shoulder arm section 30 is generally received in the forwardly-positioned shoulder pocket section 52.

It is further noted that, as illustrated, the direction of insertion is parallel to, but spaced from the rotation axis A-A. This particular direction of insertion and orientation may provide some benefits when the cone arm receives an axial load during use since the cone arm is simply forced further into the pocket and may help to reduce or limit bending or angular forces especially in comparison to side-loaded arm assemblies or the less-supported designs from the state of the art.

At this point, and with reference being made to FIG. 5 in particular, it should be noted that one or more seals can help protect the cone arm/pocket interface. A seal 82 or gasket can be placed between the cone arm step 34 and the pocket step 56 and this seal or gasket can form a forward seal that prevents ingress of particulate or fluids into the interface between the steps 34 and 56. Likewise, the mounting plate 80 on the rear side of the base wall 64 can include a one or more of fastener seals 84 and 86 between the forwardly-facing surface of the mounting plate 80 and the rearwardly-facing surface of the base wall 64 that encircles the fasteners 74 and 76 to form a seal between the body of the fasteners 74 and 76 and the mounting plate 80 as well as a larger seal 88 or gasket that more closely follows the outer periphery of the mounting plate 80 and forms a seal between the rearward facing wall of the base wall 64 of the pocket 18 and the mounting plate 80. These various rearward seals can prevent ingress of particulate or fluids into the two base openings 70 and 72 on the fastener mounting side of the cone arm 16 and pocket 18. Of course such seals are exemplary, and other sealing configurations might be used to similar effect. This allows for a more easily replaceable design and a more effective pocket for replacement than in known hole opener/cone arm assemblies.

There are also lock washers 90 which are placed between forwardly-facing surfaces of the heads of the fasteners 74 and 76 and the rearwardly-facing surface of the mounting plate 80.

Returning now to the method of assembly, with the cone arm 16 received in the pocket 18, the fasteners 74 and 76 can then be axially inserted through openings in the mounting plate 80, through the pair of base openings 70 and 72 of the pocket 18, and into the pair of axially-extending rearwardly-facing openings 48 and 50 of the cone arm 16. The fasteners 74 and 76 can then be tightened down to draw the cone arm 16 into the pocket 18. During this tightening of the fasteners 74 and 76, the rearwardly-positioned tapered arm section 32 is compressed in the rearwardly-positioned tapered pocket section 54. As the fasteners 74 and 76 are tightened, the tapered profiles of the cone arm 16 and the pocket 18 are drawn into one another to pre-load the cone arm 16 into the pocket 18. In so doing, it is possible that an interference fit may be formed between the two tapered sections upon the tightening of the fasteners, locking the cone arm 16 in the pocket 18, although the load need not be so high that, upon the release of the fastener load for disassembly, this interference fit is maintained (meaning the cone arm and pocket might be separated from one another without needing to overcome an interference fit). Notably, the forward sections—that is, the forwardly-positioned shoulder arm section 30 and the forwardly-positioned shoulder pocket section 52—are also drawn into one another, but a slight gap will remain between the cone arm step 34 and the pocket step 56 as well as between the opposing lateral side walls 36 and 38 and a inwardly-facing side wall 40 of the cone arm 16 and the opposing lateral side walls 58 and 60 and an outwardly-facing side wall 62 of the pocket 18.

In this arrangement, the fasteners 74 and 76 alone can secure the cone arm 16 in the pocket 18. No welds are necessary and the attachment is structurally robust enough for operation of the hole opener 10, especially since the pockets 18 are axially-extending and supported on various sides (entirely in the rearward regions of the taper and on three side as illustrated in the forward region of the "keyed pocket"). While the engagement of the tapered sections largely secures the cone arm 16 in the pocket 18, the "keyed pocket" forward portion including the forwardly-positioned shoulder arm section 30 and the forwardly-positioned shoulder pocket section 52 can also play an important role during use. When various cone arms 16 of the hole opener 10 are subjected to various stresses during cutting, which can be irregular and sudden given the nature of the usage, the various walls of the "keyed front pocket" sections and/or the steps 34 and 36 between the front pocket sections and the rear tapered sections can come into contact with one another, at least temporarily, to more evenly distribute the stress between the components, reducing the likelihood of cone arm failure or pocket breakout. This support may happen under extreme axial compression and/or involve, from the application of side or radial loads, twisting or turning stresses of the cone arm relative to the pocket. Still further, as the walls of the keyed front pocket as situated in the manner illustrated, in addition to protection against torsional stress of the arms within the pockets, there additional support provided when loads are incurred in the radially inward facing direction, which could be generated, for example, by the outside of the cone arm contacting a side of the opening being cut.

It is noted that while two fasteners are illustrated, it is contemplated that only a single fastener might be used instead to secure the cone arm in the pocket. However, one benefit of a multi-fastener arrangement is that the front sections or portions of the cone arm and pocket may be more closely controlled and the tightening of the fastener may be less prone to cause some amount of rotation of the forward sections relative to one another, which could create an uneven gap between the walls or even initial contact.

One benefit of this design is that, should a cone arm fail during operation of the hole opener or it be desired to simply replace one type of cone arm/cutter with another type of cone arm/cutter, it is comparably easy to loosen the fasteners and remove the cone arm from the pocket rather than have to cut out the cone arm if it was welded into place. Furthermore, since a body of a hole opener can only have an arm welded and removed so many times, the fastener mounting structure ostensibly should provide greater longevity of the assembly. Again, as mentioned above the taper and keyed pocket design can help to improve stress distributions under harsh loading conditions. Still further, the disclosed construction provides a weldless design in which seals can be provided to prevent ingress of debris into the interface which could create undesirable stress distributions upon loading at the interface between the cone arm and pocket.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A hole opener comprising:

a body extending along a rotational axis;

a plurality of pockets formed in the body and angularly arranged about the rotational axis of the body, wherein each of the plurality of pockets includes a forwardly-positioned shoulder pocket section, a rearwardly-positioned tapered pocket section and a base opening axially extending through a wall of the corresponding pocket that receives a fastener therethrough;

a plurality of cone arms, in which each of the cone arms include a cone head attached to an arm and in which the arm includes a forwardly-positioned shoulder arm section, a rearwardly-positioned tapered arm section, and a rearwardly-facing opening axially extending through the rearwardly-positioned tapered arm section that receives the fastener;

a pocket step between the rearwardly-positioned tapered pocket section and the forwardly-positioned shoulder pocket section; and a cone arm step between the rearwardly-positioned tapered arm section and the forwardly-positioned shoulder arm section;

wherein, when each of the plurality of cone arms is inserted into a corresponding one of the plurality of pockets and the corresponding fastener is tightened, the rearwardly-positioned tapered arm section is securely drawn into the rearwardly-positioned tapered pocket section of the pocket to create a pre-loaded fit therebetween and the forwardly-positioned shoulder arm section of the respective cone arm mates with the forwardly-positioned shoulder pocket section of the respective pocket.

2. The hole opener of claim 1, wherein, by virtue of the pre-loaded fit between the rearwardly-positioned tapered arm section and the rearwardly-positioned tapered pocket section by their drawing together by the fastener, an interference fit is established between the rearwardly-positioned tapered arm section and the rearwardly-positioned tapered pocket section.

3. The hole opener of claim 1, wherein the pre-loaded fit between the rearwardly-positioned tapered arm section and the rearwardly-positioned tapered pocket section by their drawing together by the fastener does not provide sufficient loading to establish an interference fit between the rearwardly-positioned tapered arm section and the rearwardly-positioned tapered pocket section that is maintained upon release of the fastener for disassembly of the cone arm from the pocket.

4. The hole opener of claim 1, wherein the forwardly-positioned shoulder pocket section and the forwardly-positioned shoulder arm section have a rectangular-shaped geometry.

5. The hole opener of claim 1, wherein the fastener comprises a plurality of fasteners and wherein the plurality of cone arms are secured in the plurality of pockets by the plurality of fasteners and wherein there are no welds holding the plurality of cone arms in the plurality of pockets.

6. The hole opener of claim 1, wherein the forwardly-positioned shoulder pocket section and the forwardly-positioned shoulder arm section having corresponding profiles and mate with one another, but do not form an interference fit.

7. The hole opener of claim 1, wherein the outer diameter of the hole opener is in a range of 12 to 60 inches.

8. A hole opener comprising:

a body extending along a rotational axis;

a plurality of pockets formed in the body and angularly arranged about the rotational axis of the body, wherein each of the plurality of pockets includes a forwardly-positioned shoulder pocket section, a rearwardly-positioned tapered pocket section and a base opening axially extending through a wall of the corresponding pocket that receives a fastener therethrough;

a plurality of cone arms, in which each of the cone arms include a cone head attached to an arm and in which the arm includes a forwardly-positioned shoulder arm section, a rearwardly-positioned tapered arm section, and a rearwardly-facing opening axially extending through the rearwardly-positioned tapered arm section that receives the fastener;

wherein, when each of the plurality of cone arms is inserted into a corresponding one of the plurality of pockets and the corresponding fastener is tightened, the rearwardly-positioned tapered arm section is securely drawn into the rearwardly-positioned tapered pocket section of the pocket to create a pre-loaded fit therebetween and the forwardly-positioned shoulder arm section of the respective cone arm mates with the forwardly-positioned shoulder pocket section of the respective pocket; and wherein the rearwardly-positioned tapered pocket section of each of the pockets includes a tubular insert in the body and wherein the tubular insert includes a taper that contacts the rearwardly-positioned tapered arm section of the cone arm.

9. A hole opener comprising:

a body extending along a rotational axis;

a plurality of pockets formed in the body and angularly arranged about the rotational axis of the body, wherein each of the plurality of pockets includes a forwardly-positioned shoulder pocket section, a rearwardly-positioned tapered pocket section and a base opening axially extending through a wall of the corresponding pocket that receives a fastener therethrough;

a plurality of cone arms, in which each of the cone arms include a cone head attached to an arm and in which the arm includes a forwardly-positioned shoulder arm section, a rearwardly-positioned tapered arm section, and a rearwardly-facing opening axially extending through the rearwardly-positioned tapered arm section that receives the fastener;

wherein, when each of the plurality of cone arms is inserted into a corresponding one of the plurality of pockets and the corresponding fastener is tightened, the rearwardly-positioned tapered arm section is securely drawn into the rearwardly-positioned tapered pocket section of the pocket to create a pre-loaded fit therebetween and the forwardly-positioned shoulder arm section of the respective cone arm mates with the forwardly-positioned shoulder pocket section of the respective pocket; and wherein the rearwardly-positioned tapered pocket section and the rearwardly-positioned tapered arm section have a cylindrically-shaped tapered geometry.

10. The hole opener of claim 9, wherein the rearwardly-positioned tapered pocket section and the rearwardly-positioned tapered arm section have a taper of 7 to 15 degrees.

11. A hole opener comprising:

a body extending along a rotational axis;

a plurality of pockets formed in the body and angularly arranged about the rotational axis of the body, wherein each of the plurality of pockets includes a forwardly-positioned shoulder pocket section, a rearwardly-positioned tapered pocket section and a base opening axially extending through a wall of the corresponding pocket that receives a fastener therethrough;

a plurality of cone arms, in which each of the cone arms include a cone head attached to an arm and in which the arm includes a forwardly-positioned shoulder arm section, a rearwardly-positioned tapered arm section, and a rearwardly-facing opening axially extending through the rearwardly-positioned tapered arm section that receives the fastener;

wherein, when each of the plurality of cone arms is inserted into a corresponding one of the plurality of pockets and the corresponding fastener is tightened, the rearwardly-positioned tapered arm section is securely drawn into the rearwardly-positioned tapered pocket section of the pocket to create a pre-loaded fit therebetween and the forwardly-positioned shoulder arm section of the respective cone arm mates with the forwardly-positioned shoulder pocket section of the respective pocket;

wherein the fastener comprises a group of fasteners;

wherein each of the plurality of cone arms is securely drawn into a corresponding one of the plurality of pockets by the group of fasteners and each of pairs of cone arms and pockets is secured using more than one fastener; and wherein the more than one fastener used to secure each of pairs of cone arms and pockets are arranged at different radial distances from the rotational axis.

12. A method of installing a cone arm into a hole opener, the method comprising:

inserting a cone arm including a cone head attached to an arm in which the arm includes a forwardly-positioned shoulder arm section, a rearwardly-positioned tapered arm section, and a rearwardly-facing opening axially extending through the rearwardly-positioned tapered arm section into a pocket formed in a body of the hole opener in which the pocket includes a forwardly-positioned shoulder pocket section, a rearwardly-positioned tapered pocket section and a base opening axially extending through a wall of the corresponding pocket such that the rearwardly-positioned tapered arm section of the arm is received in the rearwardly-positioned tapered pocket section of the pocket and such that the forwardly-positioned shoulder arm section is received in the forwardly-positioned shoulder pocket section of the pocket;

securing the cone arm into the pocket by tightening a fastener that is received through the base opening of the pocket and into the rearwardly-facing opening axially of the cone arm to draw the cone arm into secured engagement with the pocket; and a step of inserting a tubular insert into the rearwardly-positioned tapered pocket section of the pocket of the body in which the tubular insert includes a taper for coming into contact with rearwardly-positioned tapered arm section and wherein the step of insertion of the tubular insert occurs before the step of inserting the cone arm into the pocket.

13. The method of claim 12, further comprising a step of removing the cone arm from the pocket by removing the fastener.

14. The method of claim 12, wherein the method involves no welding of the cone arm into the pocket.

15. The method of claim 12, wherein securing the cone arm into the pocket by tightening the fastener creates a pre-loaded fit between the rearwardly-positioned tapered arm section of the arm and the rearwardly-positioned tapered pocket section of the pocket.

16. The method of claim 15, wherein securing the cone arm into the pocket by tightening the fastener creates an interference fit between the rearwardly-positioned tapered arm section of the arm and the rearwardly-positioned tapered pocket section of the pocket.

17. The method of claim 15, wherein securing the cone arm into the pocket by tightening the fastener does not establish an interference fit between the rearwardly-positioned tapered arm section of the arm and the rearwardly-positioned tapered pocket section of the pocket that is maintained upon release of the fastener for disassembly of the cone arm from the pocket.

18. The method of claim 17, wherein, upon use of the hole opener in a drilling operation, at least some of the surfaces of the forwardly-positioned shoulder pocket section and the forwardly-positioned shoulder arm section contact one another to distribute stress from the cone arm to the pocket in the surfaces of contact between the forwardly-positioned shoulder pocket section and the forwardly-positioned shoulder arm section and not just the rearwardly-positioned tapered arm section of the arm and the rearwardly-positioned tapered pocket section.

19. The method of claim 12, wherein the forwardly-positioned shoulder pocket section and the forwardly-positioned shoulder arm section having corresponding profiles and mate with one another, but do not form an interference fit.

* * * * *